US006893238B2

(12) United States Patent
Eisenmann et al.

(10) Patent No.: US 6,893,238 B2
(45) Date of Patent: May 17, 2005

(54) RING GEAR MACHINE CLEARANCE

(76) Inventors: Siegfried A. Eisenmann, Conchesstrasse 25, 88326 Aulendorf (DE); Hermann Härle, Conchesstrasse 23, 88326 Aulendorf (DE)

( * ) Notice: Subject to any disclaimer, the term of this patent is extended or adjusted under 35 U.S.C. 154(b) by 0 days.

(21) Appl. No.: 10/377,951

(22) Filed: Mar. 3, 2003

(65) Prior Publication Data

US 2004/0022660 A1 Feb. 5, 2004

(30) Foreign Application Priority Data

Mar. 1, 2002 (EP) ..... 02004344

(51) Int. Cl.[7] ..... F04C 18/00
(52) U.S. Cl. ..... 418/171; 418/166; 74/462
(58) Field of Search ..... 418/171, 166, 418/61.3; 74/462

(56) References Cited

U.S. PATENT DOCUMENTS

| | | | | | |
|---|---|---|---|---|---|
| 1,682,563 | A | * | 8/1928 | Hill | 74/462 |
| 1,909,117 | A | * | 5/1933 | Pigott | 74/462 |
| 2,389,728 | A | * | 11/1945 | Hill | 74/462 |
| 2,960,884 | A | * | 11/1960 | Hill | 74/462 |
| 3,305,167 | A | | 2/1967 | Nagata | |
| 3,907,470 | A | * | 9/1975 | Harle et al. | 418/170 |
| 5,368,455 | A | | 11/1994 | Eisenmann | |
| 5,649,815 | A | | 7/1997 | Hansen et al. | |
| 5,695,425 | A | * | 12/1997 | Hashimoto et al. | 74/462 |
| 5,772,419 | A | | 6/1998 | Hansen et al. | |
| 6,077,059 | A | * | 6/2000 | Hosono | 418/171 |

FOREIGN PATENT DOCUMENTS

| | | |
|---|---|---|
| DE | 14 26 765 | 8/1969 |
| DE | 42 00 883 | 4/1993 |
| DE | 43 11 168 | 10/1994 |
| DE | 43 11 169 | 10/1994 |
| EP | 0 173 778 | 3/1986 |
| JP | 10-205458 | 8/1998 |

OTHER PUBLICATIONS

European Search Report, from European Application No. 02 00 4344, dated Jul. 3, 2002.

* cited by examiner

*Primary Examiner*—Theresa Trieu
(74) *Attorney, Agent, or Firm*—RatnerPrestia

(57) ABSTRACT

A displacement-type ring gear machine includes a casing including a gear chamber comprising a supply port and a discharge port, an internal gear accommodated in the gear chamber and comprising an external toothing, and an external gear eccentric to the internal gear and comprising an internal toothing meshing with the external toothing so as to form expanding and contracting fluid cells which direct the working fluid from the supply port to the discharge port. The meshing toothings comprise a radial clearance and a tangential clearance which is smaller than the radial clearance. The tips or roots of at least one of the two toothings comprise a profile derived from a cycloid. The profile of the tips and roots of the at least one of the toothings is formed by or from the locus of a point on the circumference of a pitch circle rolling on a fixed circle, the radius of the pitch circle becoming continuously smaller from the two flank portions to the vertex portion in the case of the tips and becomes continuously larger or continuously smaller in the case of the roots.

26 Claims, 5 Drawing Sheets

RING GEAR MACHINE CLEARANCE

FIELD OF THE INVENTION

The invention relates to the clearance of displacement-type ring gear pump and motor running sets.

BACKGROUND OF THE INVENTION

Ring gear pumps compress a working fluid in delivering it from a low-pressure side to a high-pressure side whilst ring gear motors are powered by compressed working fluid supplied at a high-pressure side and discharged at a low-pressure side of the ring gear motor. Both kinds of ring gear machine include a running set comprising an internal spur gear with an external toothing and an external spur gear with an internal toothing. The internal toothing generally features one tooth more than the external toothing. The two toothings are meshed. When one gear is rotated relative to the other, circulating, expanding and contracting fluid cells materialize between the teeth of the internal gear and the teeth of the external gear, which in a pumping mode direct the fluid from a low-pressure side to a high-pressure side, and in a motor mode from a high-pressure side to a low-pressure side of the ring gear machine.

For such running sets, it is worth configuring the tips of the internal gear and the roots of the external gear as epicycloids, and the roots of the internal gear and the tips of the external gear as hypocycloids. The epicycloids are formed by the rolling action of a small pitch circle, which may be, but need not necessarily be, the same for the internal gear and the external gear, on the rolling circle of the internal gear and external gear, respectively. The hypocycloids are formed correspondingly, the small pitch circles on the internal gear and external gear again being advantageously the same but not necessarily so.

The clearance of the two gears should vary in accordance with speed and the pressure level of the working fluid. For a high relative speed of the gears a large clearance is desirable due to the friction and the differences in temperature between the two gears. At a low relative speed and mostly high working pressure on the high-pressure side, small clearances are desirable to minimize volumetric losses (leakage losses). However, other influencing factors exist which should be taken into account when dimensioning the clearances. Such other influencing factors are, in particular, the inevitable out-of-round of the toothing due to production never being perfect, the accuracy in rotationally mounting one or both gears and the deviation between the actual eccentricity of the gears and an eccentricity forming the basis of the calculated toothing; eccentricity in this context is understood, as usual, to be the spacing of the rolling circle axes of the gears.

DE 42 00 883 solves the problem of radial clearance by flattening the epicycloids or hypocycloids or both in combination to a certain extent in the direction of their rolling circles. To obtain the flattening, a smaller pitch circle is rolled on a large fixed circle for each cycloid, the profile of the toothing, however, being described not by a point on the circumference of the small pitch circle but by a point which is shifted from the circumference of the small pitch circle toward its center. The resulting cycloids of the toothing are interconnected by straight pieces. The tangential clearance needed at the point of full mesh, i.e. the backlash, is obtained by equidistantly offsetting the contour of at least one of the toothings obtained by the rolling action of the pitch circles. In this known type of toothing, calculating the point of transition from the epicycloids to the hypocycloids is highly involved. Apart from this, mechanical noise materializes due to discontinuous locations.

EP 1 016 784 A recommends generating the cycloids of the internal rotor and external rotor by the rolling action of four small pitch circles, each different in radius. Although this permits adjustment of a radial clearance while avoiding discontinuous locations, this is at the cost of a tangential clearance larger than the radial clearance, due to the specification in generating the epicycloids and hypocycloids. At the point of full mesh, the gap formed between the toothings from the vertex of the mating tip to the flanks of the corresponding tooth is thus widened, resulting in the toothing being problematic. An excessive backlash circumferentially results in chatter circumferentially in the region of the rolling circle because of hydraulic and dynamic forces prompting a change in flank contact. If the tangential clearance is excessive, the fluid film between the slide-rolling flanks of the gear is too thick and the shock caused by the change in flank contact is thus inadequately dampened. Chatter is inevitable especially at high speeds, low viscosity of the working fluid and large diameters of the running set. Furthermore, increasing the clearance in the direction of the flanks is detrimental to the volumetric efficiency of the ring gear machine.

SUMMARY OF THE INVENTION

It is an object of the invention to configure meshing toothings of an internal-axis running set of a ring gear machine such that the volumetric efficiency is improved and the noise developed by the running set is reduced. At the same time, the toothings are intended to be based on a simple mathematical specification for generating them.

A ring gear machine such as the invention relates to comprises a casing with a gear chamber including a supply and a discharge for the working fluid. The working fluid is preferably a liquid, in particular a lubricant oil or a hydraulic fluid. The ring gear machine further comprises a running set of at least one outer-toothed internal gear and one inner-toothed external gear in mesh with each other. If both gears rotate relative to the casing the running set is accommodated in the gear chamber. If one of the gears is a stator, it preferably forms the gear chamber as well. The at least two gears comprise mutually eccentric rolling circle axes. The internal toothing of the external gear comprises at least one tooth more than the external toothing of the internal gear; it preferably comprises precisely one tooth more. In the rotary drive action of one of the gears, the meshing toothings form expanding and compressing fluid cells, i.e. which become larger and smaller, for directing the working fluid from the supply to the discharge.

In most applications, both of the at least two gears of the running set each rotates about its own rolling circle axis, the casing usually forming a rotational mount for one of the two gears, and the other being connected non-rotationally to a rotary drive or output member. However, relative to the casing it is not necessary for both of the at least two gears to rotate about their axes of rotation. An external gear stationary relative to the casing, a so-called external stator, is known in particular in so-called orbital machines, indicating that the internal gear executes two orbital motions in the external stator stationary relative to the casing, namely a circular orbital motion about an axis of rotation fixed relative to the casing, and a rotational motion about its own rolling circle axis.

As regards the shape of the teeth of at least one of the meshing toothings, their tips or roots or their tips and roots in combination are derived from cycloids, i.e. the tip or root contour involved can be generated by the rolling action of a pitch circle on a fixed circle. The fixed circle is concentric to the rolling circle axis of the corresponding toothing. Accordingly, derived cycloids as termed in the following are to be understood as cycloids which can be generated by the rolling action of a pitch circle of variable radius on a fixed circle. The meshing toothings run with a radial and a tangential clearance. The radial clearance is understood to be the spacing between the addendum circle of the one toothing and the dedendum circle of the other toothing when the toothings feature, relative to each other, the eccentricity forming the basis of their generation. The tangential clearance under the same conditions is the backlash of the rear flanks, i.e. the circumferential clearance as guaged on the rolling circle of one of the gears at the point of full mesh.

The invention relates to the above definition of the clearances. In practice, however, gauging is done expediently in a gauging machine, by gauging each of the gears of the running set individually as to their addendum circle and dedendum circle and computing the clearances from the data obtained.

One particularly simple gauging method, likewise suitable in practice, involves gauging the radial clearance $P_R$ as the spacing between the opposing tips at the point of minimum mesh, with the gears removed and urged radially against each other by their toothings at the point of full mesh. When in this condition, the two toothings are exactly urged only radially against each other, a backlash circumferentially remains between the two toothings at the point of full mesh on both sides of the vertex of the mating tip. The sum of each backlash on both sides on the rolling circle of one of the gears represents the tangential clearance in a first approximation. By actually urging the toothings against each other, a radial clearance can likewise be gauged in a first approximation at the point of minimum mesh simply by inserting a feeler gauge between the opposing tips of the toothings.

These indications as to gauging clearance in practice are made merely on a supplementary note since the two clearances, as already mentioned above, relate to the conditions forming the basis for generation, such as in particular precise eccentricity, i.e. the more precisely the gears are produced and the clearances are gauged, the more the clearances obtained by gauging in practice will approximate the mathematical clearances in the sense of the invention.

In accordance with the invention, the meshing spur toothings are configured such that the tangential clearance is smaller than the radial clearance. In accordance with the specification of the invention for generating the at least one of the toothings, the profile of the tips or roots of this toothing is formed by the locus or from the locus of a point on the circumference of a small pitch circle whose radius becomes continuously smaller from the two flank portions to the vertex portion for generating the tip profile, or becomes continuously larger for generating the root profile. Further advantageous is a root profile which is formed by the locus or from the locus of a point on the circumference of a small pitch circle whose radius becomes continuously smaller from the two flank portions to the vertex portion of each root. Such a root profile, which is flattened in the direction of the rolling circle of the corresponding gear in accordance with the invention, can be generated both mathematically and in practice by simple ways and means and can serve in particular to improve the support of one gear on the other and also to reduce a dead volume to a meshing flattened tip. In conjunction with the flattening of the roots, such a flattened tip can in particular be a tip in accordance with the invention or also a flattened tip in accordance with another specification for generating it. The Applicant reserves the right to claim a gear having a toothing in accordance with a specification for generating it in accordance with the invention, for varying the pitch circle, as well as a running set including such a gear, in particular a running set for ring gear machine, even without the feature of the larger radial clearance in accordance with the invention.

Preferably, the radius of the corresponding pitch circle continuously changes from both root points of each tip or root on the rolling circle of the toothing. The locus generated or generable by this specification may form the corresponding profile directly. However, the profile may also be based only on such a locus by, for example, being offset equidistantly behind the correspondingly locus. The deviation of the profile from the locus generated in accordance with the specification for generating it is, however, never more than that permitting the small tangential clearance in accordance with the invention to be set.

The pitch circle may be a small pitch circle not encircling the larger fixed circle, and rolling externally on the fixed circle. The pitch circle may, however, also be a large pitch circle rolling externally on the fixed circle but encircling the in this case smaller fixed circle. Mathematically, this involves a motion of two cranks in the plane of the rolling circle of the toothing to be generated. The two cranks are interconnected in a pivot. The one of the two cranks rotates about a fixed fulcrum on the axis of the rolling circle, whilst the outer of the two cranks, as viewed from the fixed fulcrum, rotates about the fulcrum of the common pivot. The angular velocities of the two cranks differ, but are each constant. In the rolling action of a non-encircling small pitch circle on a large fixed circle, the inner crank rotating about the fixed fulcrum is longer than the outer crank rotating about the fulcrum of the common pivot. Where the rolling action of an enclosing large pitch circle on a small fixed circle is concerned, the inner crank is smaller than the outer crank. The fact that the same toothing can be generated in each case by both rolling actions, i.e. by both crank relationships, has been demonstrated, for example by O. Baier in the German paper on rotary and orbital piston engines as internal combustion engines, published in 1960 in Report No. 45 of VDI. The invention also relates back to this, in that it is not defined whether the pitch circle is the smaller or the larger of the two circles. In addition, the definition of the tip and/or root profile as the locus of a point on the circumference of a pitch circle does not restrict the invention by to the radius of the corresponding pitch circle actually changing for generating the profile concerned. If the same locus can also be generated by the rolling action of a pitch circle having a constant radius on a circle, concentric to the axis of the rolling circle, and continuously changing in radius, or by some other specification, then a profile generated in accordance with such a specification is also understood to be in accordance with the invention.

A small tangential clearance makes for a small shock pulse distance between the flanks of the two toothings for one thing, and for another for a thinner fluid film between the flanks, which builds up higher squeeze pressures and thus prevents flank contact better than in known toothings.

It will readily be appreciated that the invention now makes it simple to take into account the specific clearance requirements in any particular application, whilst permitting a high degree of freedom in configuring the toothing. It is possible not only to predefine the clearance at the salient mesh points, but also to simultaneously take into account the specific requirements in production such as, for example, thermal distortion, distortion in calibrating sintered components or tool deformation in broaching or sintering the gear blanks. Operating the ring gear machine in accordance with the invention at working pressures as high as several hundred bar necessitates taking into account the elastic deformation of the gears, which likewise makes it necessary to correct the selected tooth shape. Making such corrections is not possible with classical cycloid toothings generated with the aid of pitch circles and fixed circles each of constant radius. Systematically modifying cycloids, as proposed by the invention, combines the advantage of a simple generation specification with the newly obtained freedom of varying the clearance in accordance with the particular application.

The invention is also advantageous with respect to producing the gears, since the production tolerances as gauged over the tooth thickness, i.e. circumferentially, may be substantially smaller than the production tolerances as gauged over the gear diameter, i.e. radially. This is due to the out-of-round and ovality of the gears. It is particularly where ring gear pumps are concerned, whose internal gear is directly mounted on a crankshaft of a piston engine and which are known to produce a pronounced radial motion in their main bearings, that an increased radial clearance of the meshing gears is advantageous. This is usually the case for assembling lube pumps on automotive internal combustion engines, which represents a preferred use of a ring gear pump in accordance with the invention.

Computing the points on the locus in accordance with the invention is mathematically very simple, using a running parameter preferably selected as the centering angle $\chi$ between the X axis and a travel beam, namely the inner crank. The X axis and said travel beam meet at the centerpoint of the rolling circle of the corresponding gear, i.e. in its rolling circle axis. Incrementing the running parameter by the usual methods is very simple, without resulting in any discontinuities in the tip/root transition. A tip of the external toothing generated in accordance with the invention thus translates tangentially into a, for example, hypocycloid root or a root likewise generated in accordance with the invention. The same applies, of course, also to a root of the external toothing generated in accordance with the invention, which then translates tangentially into a, for example, epicycloid tip or a tip of the external toothing likewise generated in accordance with the invention. When the toothing formed in accordance with the invention is an internal toothing, this applies in the same sense to the, for example, epicycloid roots or roots derived from epicycloids in accordance with the invention and to, for example, hypocycloid tips or tips derived from hypocycloids in accordance with the invention.

For the variable radius of the pitch circle for the tips and/or roots of the toothing, r=constant accordingly does not apply, but rather $r=r(\chi)$. When $r_0$ represents the largest radius of the pitch circle for generating tips in accordance with the invention, and $r_0$ represents the smallest radius of the pitch circle for generating roots in accordance with the invention, then $r(\chi)=r_0\pm\Delta r(\chi)$, where $r(\chi)=r_0$ in the outermost point of the tip or root flank, and $\Delta r(\chi)$ is continuous, preferably continuously differentiable.

The function according to which the pitch circle radius changes in accordance with the invention can be selected in accordance with the expedience specified. The pitch circle radius may change in particular in accordance with a linear function or an at least second order function, preferably a conic section function, such as for example a parabolic function or a polynome. Particularly preferred are sine or cosine functions, in particular because of their simplicity. The change in the pitch circle may also be specified on the basis of values gained from experience at supporting points, and approximated with the aid of an interpolation function on the supporting points. An interpolation function thus obtained is termed an experience function in the sense of the invention.

It is particularly preferred to vary the pitch circle radius from a constant value $r_0\neq 0$ starting from a function $\Delta r(\chi)$ featuring a slope of zero on both sides of the vertex of the tip or root generated in accordance with the invention at the starting point at $\chi=0$ and at the end point at $\chi=2\chi_s$, where $\chi_s$ identifies the centering angle of the vertex.

The change in the pitch circle radius on both sides of the vertex of each tip or each root is preferably the same, such that the tips and/or roots generated in accordance with the invention feature a symmetrical profile on both sides of their vertex.

For generating the tip and/or root profile in accordance with the invention, a number of different functions, preferably from the group of those cited, can be used, as long as these functions translate continuously, preferably continuously differentiably and thus tangentially, into each other. The change in the radius should be monotonous, i.e. in generating the tip profile, for example, the radius should in the rolling action grow monotonously toward the two flanks from the vertex of the tip. However, the change in the radius need not necessarily occur continuously throughout the entire rolling action, although a continual change is advantageous. Thus, the radius can be partially constant throughout, especially in the region of the flanks, so as to become smaller towards the vertex from, for example, a tip, the radius function however being continuous everywhere for each tip or root.

The counterpart toothing of the toothing generated in accordance with the invention is preferably likewise generated in accordance with the invention, i.e. it preferably comprising tips and/or roots likewise generated in accordance with the invention. The counterpart toothing may, however, also be a purely epicycloid or hypocycloid toothing, i.e. comprising tips and roots which are preferably precise or lengthened or shortened epicycloids and preferably precise, lengthened or shortened hypocycloids. Thus the tips of the external toothing and the tips of the internal toothing especially may each be generated in accordance with the invention, whilst the roots of the external toothing are hypocycloids and the roots of the internal toothing are epicycloids. The counterpart toothing need not, however, necessarily comprise epicycloids and hypocycloids, it can just as well be formed, for example, in accordance with the toothing law. It is, however, preferred that both toothings comprise only tips and roots which are cycloid or derived from cycloids in accordance with the invention, wherein combinations as described and furthermore as claimed are possible.

If, in the at least one toothing generated in accordance with the invention, either only the tips or only the roots are derived from a cycloid in accordance with the invention, then generating the tips in accordance with the invention is preferred, although only generating the roots in accordance with the invention is still advantageous. By flattening the tips in accordance with the invention, the required radial clearance at the point of minimum mesh and space for squeeze fluid at the point of full mesh are obtained at the same time. If only the roots are generated by increasing the pitch circle in accordance with the invention, at least space for squeeze fluid at the point of full mesh is also created, whilst the radial clearance required at the point of minimum mesh may be achieved by other means which may be known.

For generating the radial clearance, it is normally sufficient for only one pitch circle radius of one of the two toothings to be continuously varied in the rolling action on the corresponding fixed circle for forming the tip profile. If, however, to reduce detrimental spaces and for optimum radial guidance of the gears with respect to each other, the tips and roots of the counterpart toothing are to be adapted in shape as exactly as possible to the toothing in accordance with the invention, it is easily possible to also generate the counterpart toothing in accordance with the invention. Thus, it may be advantageous for mutual radial support of the rotors to "fetch" the roots of the counterpart toothing radially nearer to the tips formed in accordance with the invention, by most advantageously likewise generating them in accordance with the invention, but like the tips by reducing their pitch circle radius to the vertex of each root.

The tangential clearance should amount to 20 to 60% of the radial clearance, this indication again relating to the mathematical clearances and assuming precise eccentricity. It is particularly preferred if the tangential clearance is roughly half as large as the radial clearance.

For very small clearances, so-called displacement squeeze pressures may occur between the meshing gears at the point of full mesh, as the relative speed increases, which may result in heavy noise and also added wear of the gears. To prevent this, hollows may be provided in the gaps of one or where necessary both gears in the ring gear machine configured in accordance with the invention, preferably in the form of narrow axial grooves. These are connected in particular to the discharge, such that large peak squeeze pressures may be depleted without disturbing the mating and clearance conditions.

To minimize fluctuations in the instant displacement of the ring gear pump, the circumferential extent of the gaps and teeth of the gears as measured on the corresponding reference circle or rolling circle should be configured in accordance with either claim 14 or in accordance with claim 15.

The tangential clearance may advantageously be obtained by equidistantly offsetting one of the two toothings after the two toothings have been fabricated to a tangential clearance of zero in accordance with the mathematical specification for generating the loci. Likewise advantageously, the radial and tangential clearance may, however, be obtained simply by varying the pitch circle radius for the tips alone of one of the toothings. If the counterpart toothing is a cycloid toothing, then the tangential clearance may also be obtained by selecting the pitch circle of the roots of the counterpart toothing to be half a tangential clearance larger than that of a pitch circle radius having a tangential clearance of zero, whilst the radius of the pitch circle of the tips of the counterpart toothing is selected to be half a tangential clearance smaller than the pitch circle radius with a tangential clearance of zero. The extent of the tooth gaps of the counterpart toothing as measured on the rolling circle is then larger by the tangential clearance and the thickness of the tips of the counterpart toothing as measured on the rolling circle is smaller by the tangential clearance than that of a counterpart toothing whose gaps and tips on the rolling circle each have the same extent and thickness as the toothing in accordance with the invention. Just as possible is, of course, the inverse situation of generating the cycloid counterpart toothing to the nominal dimension and generating the toothing in accordance with the invention to the setting of the desired tangential clearance. Where necessary, the tangential clearance can be formed by varying a pitch circle radius in combination with equidistantly offsetting one of the toothings or even, where necessary, both toothings.

For the sake of completeness, it is to be noted that the specification in accordance with the invention for generating the toothing is also applicable to so-called gerotor toothings. In this context, a precisely circular tip shape is provided in the external gear, featuring a constant flank radius. This constant flank radius stems historically from gear development, since machining a regular cylindrical shape is particularly easy to control. If the tips of the external gear are formed by rollers rotationally mounted in the gear, then the constant radius is in fact mandatory. The counterpart toothing mating with the circular tips, i.e. the external toothing of the internal gear, is formed in accordance with the invention. In this context, however, this is not a variation of a pitch circle rolling on a fixed circle. Instead, in the generator process, also termed envelope process, it is the radius of the arc of the gerotor toothing that is varied, the objective of which is, however, to prevent mating problems in the two toothings, namely the problem of the spacing between the opposing tips of the two toothings becoming undesirably large at the point of minimum mesh due to flank contact to the side of the points of full mesh and minimum mesh, resulting in a reduction in volumetric efficiency.

Varying the circular arcs of the gerotor toothing, namely of the internal toothing of the external gear, is performed such that the tips of the external toothing of the internal gear are more slender than is usually the case in the envelope process. In accordance with the invention, the radius of the arc of the tip of the internal toothing is a minimum when the vertex of the tip of the external toothing is generated. Starting from the vertex to the two flank portions of the tips of the external toothing, the radius of the arc of the tips of the internal toothing is increased, resulting in the tip of the external toothing on the rolling circle being more slender than would be the case in accordance with the envelope process having a constant radius of the arc, thus avoiding or at least reducing the risk of mating problems due to lateral mating of teeth, i.e. flank contact. This configuration in accordance with the invention is particularly advantageous when there is a danger of leakage problems between the fluid cells and/or of the internal gear deforming due to high working pressures.

Where further advantageous embodiments are described in the sub-claims, reference is made accordingly to the sub-claims.

In addition to the ring gear machine, the invention is also directed to a running set comprising meshing gears having at least one toothing generated in accordance with the invention or which is simply formed by these two gears alone.

BRIEF DESCRIPTION OF THE SEVERAL VIEWS OF THE DRAWINGS

Preferred example embodiments of the invention will now be detailed with reference to the Figures. Features disclosed by the example embodiments advantageously develop the subject matter of the claims, each individually and in any disclosed combination. Features disclosed in only one of the examples also develop other examples respectively or disclose alternatives to the individual features or combinations of features, unless disclosed otherwise or unless only that case can be. There is shown:

DETAILED DESCRIPTION OF THE INVENTION

Figure 1:
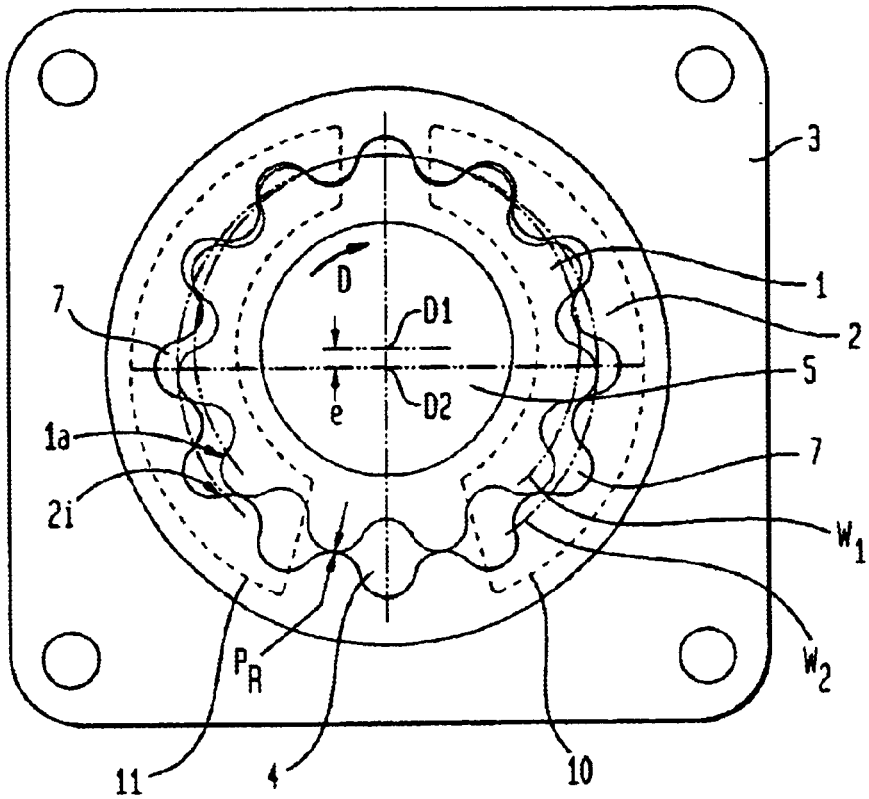
FIG. 1 a view of an internal ring gear pump comprising an internal-axis running set.

FIG. 1 shows a ring gear pump in a view perpendicular to a running set which is rotationally mounted in a gear chamber 4 of a pump casing 3. A cover of the pump casing 3 is omitted to expose the gear chamber 4 with the running set. The running set of the ring gear pump is shown again by itself in FIG. 2.

The ring gear pump comprises an internal gear 1 with an external toothing 1*a* and an external gear 2 with an internal toothing 2*i* which forms the running set. The external toothing 1*a* has one tooth less than the internal toothing 2*i*. Regarding the internal-axis running set, it is to be noted generally that the number of teeth of the internal toothing 2*i* is preferably at least four and preferably not more than 15, and more preferably at least five. In the example embodiment, the internal toothing 2*i* has twelve teeth.

An axis of rotation $D_1$ of the internal gear 1 runs parallel to and spaced away from, i.e. eccentric to, an axis of rotation $D_2$ of the external gear 2. This eccentricity, i.e. the spacing between the two axes of rotation $D_1$ and $D_2$, is identified by "e". Furthermore, the rolling circle of the internal gear 1 and the rolling circle of the external gear 2 are indicated and designated as $W_1$ and $W_2$. The axes of rotation $D_1$ and $D_2$ coincide with the rolling circle axes of the gears 1 and 2.

The internal gear 1 and the external gear 2 form a fluid delivery space between themselves. This fluid delivery space is divided into fluid cells 7, each closed off pressure-tight from the other. Each individual fluid cell 7 is formed between two consecutive teeth of the external toothing 1*a* and of the internal toothing 2*i*, by each two consecutive teeth of the external toothing 1*a* having tip or flank contact with each two consecutive, radially opposing teeth of the internal toothing 2*i*. Between the tips of the two toothings 1*a* and 2*i*, at the point of minimum mesh, a minor radial clearance exists. This clearance is identified $P_R$, when the axes of rotation $D_1$ and $D_2$ exhibit the theoretical eccentricity "e" which forms the basis for generating the toothings 1*a* and 2*i*. The gap corresponding to the radial clearance $P_R$ should be dimensioned such that the inevitable losses are minimized.

From the diametrically opposed point of full mesh to the point of minimum mesh, the fluid cells 7 become increasingly larger in the direction of rotation D, to then contract back as of the point of minimum mesh. In pumping operation, the expanding fluid cells 7 form a low-pressure side and the contracting fluid cells 7 form a high-pressure side. The low-pressure side is connected to a pump supply, and the high-pressure side to a pump outlet. Axially adjoining, kidney-shaped ports 10 and 11, separated from each other by webs, are accommodated in the casing 1 in the area of the fluid cells 7. The port 10 covers fluid cells 7 on the low-pressure side, correspondingly forming a supply port, in pumping operation a low-pressure port, and the other port 11 correspondingly forms a discharge port, in pumping operation a high-pressure port. In motor operation, which is equally possible with such a ring gear machine, the relationships are of course reversed. At the point of full mesh and at the point of minimum mesh, the casing forms a sealing web between each of the adjoining supply and discharge ports 10 and 11.

When one of the gears 1 and 2 is rotary driven, fluid is drawn in through the port 10 by the expanding fluid cells 7 on the low-pressure side, transported via the point of minimum mesh, and on the high-pressure side discharged at a higher pressure through the port 11 to the pump discharge. In the example embodiment, the pump receives its rotary drive from a rotary drive member 5 formed by a drive shaft. The internal gear 1 is non-rotatably connected to the rotary drive member 5.

In a preferred application of the pump as a lube pump for an internal combustion engine, i.e. as an motor oil pump, the rotary drive member 5 is usually directly the crankshaft or output shaft of a transmission whose input shaft is the crankshaft of the engine. Equally, the rotary drive member 5 can be formed by an output shaft for equalising the force or torque of the engine. Other rotary drive members are, however, equally conceivable, in particular in other applications of the pump, for example as a hydraulic pump for an automotive servo drive. Instead of the internal gear 1 being driven, the external gear 2 could be rotary driven, slaving the internal gear 1 in its rotational motion. In the example embodiment, however, the external gear 2 is rotationally mounted in the casing 3 via its outer circumference, as is usual in most applications.

The external toothing 1*a* and the internal toothing 2*i* are configured such that the radial clearance $P_R$ is larger than the tangential clearance as measured circumferentially, i.e. tangentially, at the point of full mesh on the rolling circle of one of the gears 1 and 2, as the spacing between the trailing flanks, when the leading flank of the drive gear contacts the mating flank of the driven gear. The profile of the external toothing 1*a* and the profile of the internal toothing 2*i* are each formed by cycloids or are derived from cycloids, i.e. the tips and roots of the toothings 1*a* and 2*i* may be generated by the rolling action of pitch circles on fixed circles. To obtain a radial clearance $P_R$ larger than the tangential clearance, the profile of the tips of at least one of the toothings 1*a* and 2*i* is radially flattened in a particular way as compared to a cycloid generated by the rolling action of a pitch circle of constant radius on a fixed circle. The profile of the tips of the counterpart toothing 1*a* or 2*i* may likewise be flattened or it may also be formed, for example, from a cycloid obtained by the rolling action of a pitch circle of constant radius on a fixed circle of constant radius. In principle, although not preferred, the counterpart toothing 1*a* or 2*i* may even comprise a tip profile which is more acute than that of the cycloid, as long as it is assured that the radial clearance $P_R$ is larger than the tangential clearance.

In the example embodiment, the profile of the roots of the external toothing 1*a* is a hypocycloid, and the profile of the roots of the internal toothing 2*i* is an epicycloid. Both cycloids are generated by the rolling action of their pitch circle, each of constant radius, on the rolling circle $W_1$ or $W_2$ of the corresponding gear 1 or 2 respectively, whereby the pitch circle of the epicycloids is preferably not the same as the pitch circle of the hypocycloids.

Figure 3:
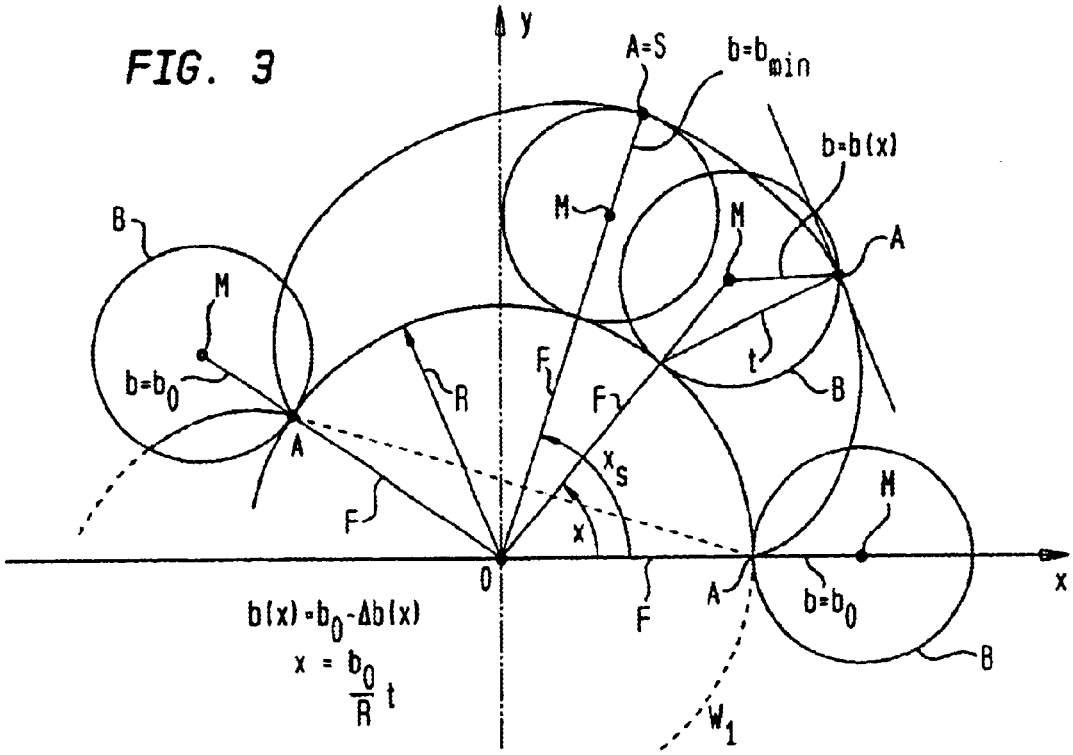
FIG. 3 a tip being generated.

FIG. 3 illustrates, by way of example, how a tip is generated for the internal gear 1. For the purposes of illustration, however, the ratio of the tooth thickness to the gear diameter is shown larger than for the internal gear 1 shown in FIG. 1.

In FIG. 3, R designates the radius of the rolling circle $W_1$. The rolling circle $W_1$ forms the large fixed circle concentric to the axis of rotation $D_1$, a smaller pitch circle B having a rolling action on this fixed circle, to generate the tips externally. The small pitch circle B has a radius b which continuously changes during the rolling action. As shown by way of example in a single tip in FIG. 3, each of the tips of the internal gear 1 is shaped identically. Due to the change in the radius r, the small pitch circle B is technically not a pitch circle, however for the purpose of illustration the term "pitch circle" will continue to be used.

Mathematically, the rolling action can be treated in particular by the motion of two cranks in the plane of the fixed circle and/or rolling circle $W_1$. One of these two cranks is the straight line F connecting the centerpoint 0 of the fixed circle $W_1$ to the centerpoint M of the pitch circle B. The centerpoint 0 of the fixed circle $W_1$ is located on the rolling circle axis $D_1$. The other crank is a straight line having the same length as the radius b of the pitch circle B. The straight line b connects a point on the circumference of the pitch circle B with the centerpoint M. As viewed from the fulcrum 0, the straight line F forms an inner crank and the straight line b an outer crank. The two cranks F and b are rotationally connected to each other at the centerpoint M.

A Cartesian X/Y coordinate system, fixedly connected to the gear 1 and having its origin at the centerpoint 0 of the fixed circle $W_1$, is also shown in FIG. 3. In a starting position in which the two cranks F and b are located one above the other on the X axis, the end point of the outer crank b is identified as A. This point A on the circumference of the pitch circle B is also located on the fixed circle $W_1$ in the starting position. The centering angle $\chi$ between the X axis defined above and the inner crank F serves as the running parameter for the crank motion. Accordingly, the centering angle $\chi$ equals zero in the starting position. A rolling action of the pitch circle B corresponds to a rotational motion of the inner crank F about the centerpoint 0 of the fixed circle $W_1$, onto which a rotational motion of the outer crank b about the centerpoint M of the pitch circle B is superimposed. In FIG. 3, the pitch circle B is shown in the starting position, two intermediate positions and an end position. In the end position, the point A of the outer crank b has returned to the fixed circle $W_1$. In one of the two intermediate positions, the point A on the circumference of the pitch circle B coincides with the vertex S of the tip profile. In this position of the pitch circle B, the outer crank b forms the in-line elongation of the inner crank F. The outer crank b exhibits its smallest length in this position, corresponding to the smallest radius $b_{min}$ of the pitch circle B. The corresponding centering angle is likewise entered, and identified by $\chi_s$. The pitch circle B exhibits its largest radius $b_0$ in the starting position at $\chi=0$ and in the end position at $\chi=2\chi_s$. Starting from the middle position $\chi=\chi_s$, at which the point A coincides with the vertex S of the tip, the radius b of the pitch circle B increases monotonously and symmetrically on both sides of the vertex S, until it has reached its largest value $b_0$ on the fixed circle $W_1$. During rolling action, the length of the inner crank F is constant. The length of the outer crank b is given by:

$$b(\chi)=b_0-\Delta b(\chi) \text{ with } \chi\epsilon(0, 2\chi_s).$$

$\Delta b$ is preferably a sine or cosine function, for example:

$$\Delta b(\chi)=(C/2)\sin((\pi\chi)/(2\chi_s)),$$

where the constant C/2 is the amount of the length by which the pitch circle radius at the vertex of the tip or root deviates from $b_0$. In accordance with the above function $\Delta b(\chi)$, the length of the outer crank b changes in accordance with the amount of the part of the sine function located between two consecutive zeros. However, it is more advantageous if the length of the outer crank b changes in accordance with the amount of the part of a sine or cosine function located between a minimum of the corresponding function and an adjacent maximum, since the length of the outer crank b in the flank portions of the tip is then a closer approximation of the epicycloids of the pitch circle having the constant radius $r_0$. Thus, $\Delta b(\chi)$ can satisfy in particular one of the two following equations:

$$\Delta b(\chi)=(C/2)\|\sin((\pi\chi)/(2\chi_s)-\pi/2)|-1|$$

$$\Delta b(\chi)=(C/2)\|\cos((\pi\chi)/(2\chi_s)|-1|,$$

wherein the perpendicular lines, as usual, identify the absolute amount.

Figure 4:
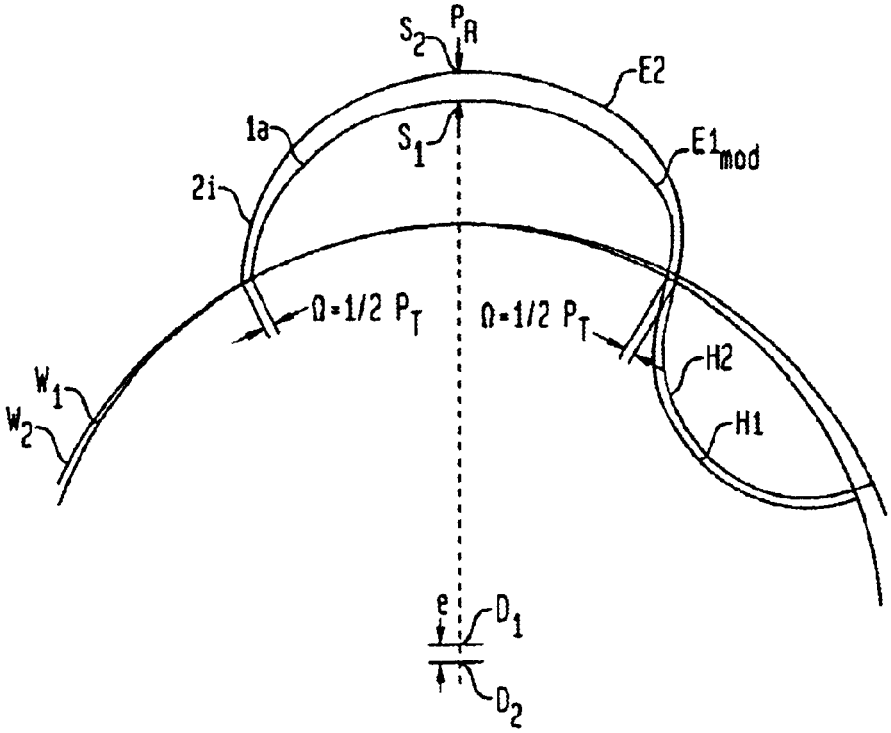
FIG. 4 a point of full mesh of a running set in a first example embodiment.
Figure 5:
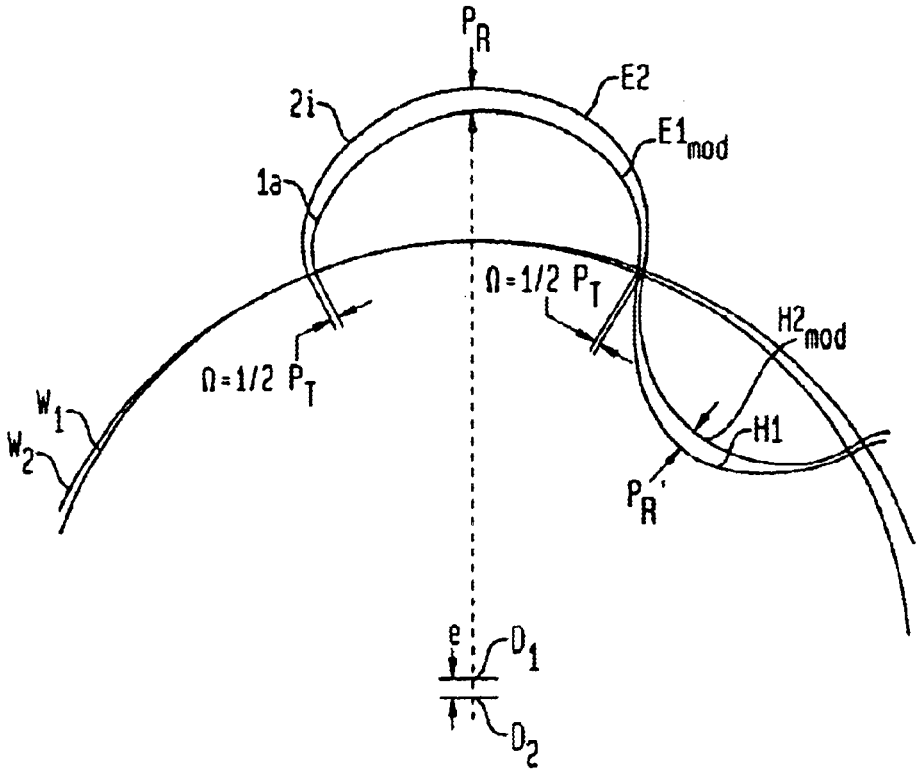
FIG. 5 a point of full mesh of a running set in a second example embodiment.
Figure 6:
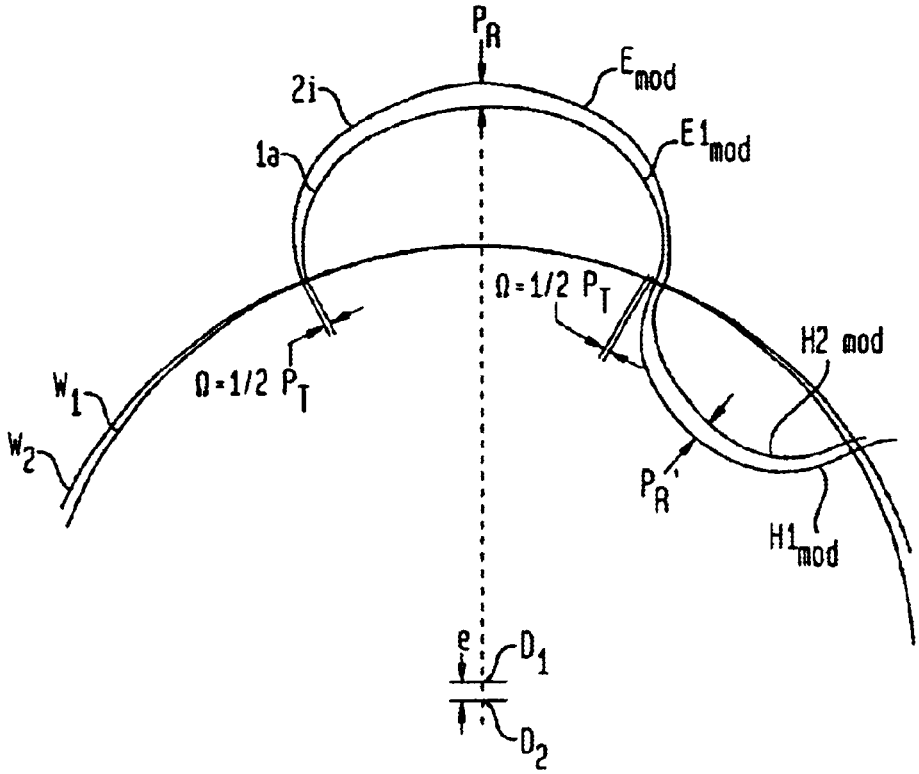
FIG. 6 a point of full mesh of a running set in a third example embodiment.

FIG. 4 and the subsequent FIGS. 5 and 6 show each of the toothings 1*a* and 2*i* where the two axes of rotation $D_1$ and $D_2$ exhibit the eccentricity e relative to each other which forms the basis for generating the toothings 1*a* and 2*i*, and the vertex $S_1$ of the tip of the external toothing 1*a* and the vertex $S_2$ of the root of the internal toothing 2*i* are located on the same radial. In the course of the running set, the two toothings 1*a* and 2*i* do not naturally assume this theoretical position, since one of the gears 1 and 2 is the rotary drive for the other. FIGS. 4 to 6 do, however, serve to illustrate example toothing pairings.

Figure 2:
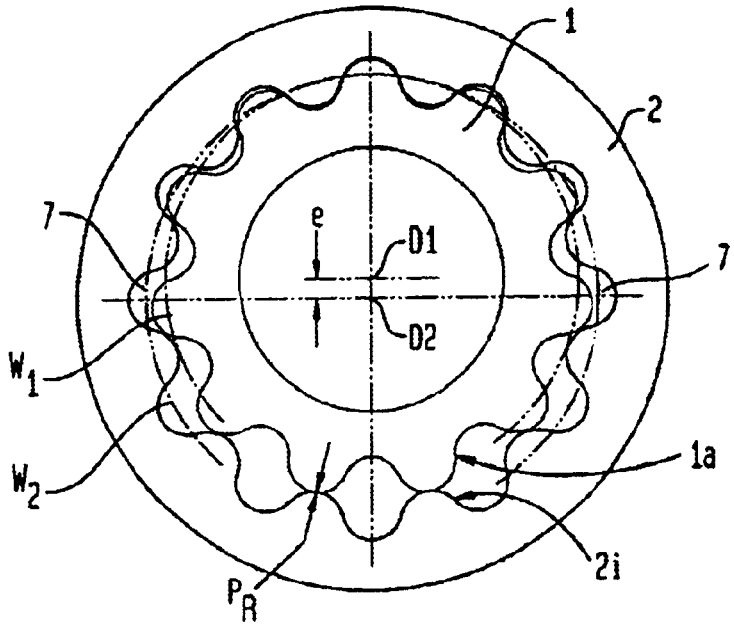
FIG. 2 the running set in FIG. 1.

FIG. 4 shows the point of full mesh for a running set in accordance with the example embodiment as set forth in FIGS. 1 and 2, in which only the external toothing 1*a* of the internal gear 1 is configured in accordance with the invention. As described above with reference to FIG. 3, the profile of each of the tips of the external toothing 1*a* is derived from an epicycloid, and correspondingly identified by $E1_{mod}$. By contrast, the profile of the roots of the external toothing 1*a* is a hypocycloid H1 which can be generated by the rolling action of a small pitch circle of constant radius on the inside of the rolling circle $W_1$. On the rolling circle $W_1$ of the internal gear 1, the tips and roots of the external toothing 1*a* merge tangentially. The internal toothing 2*i* of the external gear 2 exhibits a conventional cycloid profile comprising hypocycloid tips H2 and epicycloid roots E2 which can be generated by the rolling action of small pitch circles on the rolling circle $W_2$ of the external gear 2. The pitch circle for generating the hypocycloid tips H2 comprises the same, constant radius as the pitch circle for generating the hypocycloid roots H1 of the internal gear 1. The epicycloids E2, as measured over the rolling circle $W_2$ of the external gear 2, are just as thick as the tips $E1_{mod}$ of the internal gear 1 derived from the epicycloids.

On the basis of the constant pitch circle radius for generating the epicycloids E2, the modifying function $\Delta b$ for generating the tip profile of the external toothing 1*a* needs to be configured such that the length of the variable pitch circle B rolled on the rolling circle $W_1$or reference circle of the internal gear 1 equals the thickness of the epicycloids E2 of the internal toothing 2*i*. The specifications for generating the toothings 1*a* and 2*i* thus result in a tangential clearance $P_T$ of zero which in practice cannot be implemented. To achieve a tangential clearance $P_T$ between the gears 1 and 2 which is as small as possible, but sufficiently large for the relative motion, one of the two toothings 1*a* and 2*i* generated as described above is equidistantly, i.e. normally to the profile, offset over its entire profile, for example by means of wire erosion of a sintered gear blank obtained in accordance with the specification for generating. The amount Ω of equidistant offset in this example, given the epicycloids E2 and the derived epicycloids $E1_{mod}$ having the same thickness as measured over each rolling circle, thus equals $P_T/2$. At the point of full mesh, therefore, the two vertices $S_1$ and $S_2$ exhibit a radial spacing, following as the sum of $\Omega=P_T/2$ and $2(b_2-b_{min})$, where $b_2$ is the constant radius of the pitch circle of the epicycloids E2. This radial spacing corresponds to the radial clearance, i.e. $P_R$ is given by $P_R=2(b_2-b_{min})+\Omega$.

The same radial clearance $P_R$ results in the example as set forth in FIG. 4 at the point of minimum mesh between the tips of the two toothings 1*a* and 2*i*.

By a combination of generating for example the tip profile of the internal gear 1 in accordance with the invention and equidistantly offsetting, the tangential clearance $P_T$ can be formed by equidistant offsetting and the radial clearance $P_R$ by superimposing the equidistant offset and the change in radius $\Delta b(\chi_s)$ in accordance with the invention. This results in further ways of varying over and above that which would be possible alone by generating the profile of at least one of the toothings 1*a* and 2*i* in accordance with the invention.

If, in the example embodiment in FIG. 4, a tangential clearance $P_T$ of 0.02 mm and a radial clearance $P_R$ of 0.06 mm are for example desired, then the equidistant offset would be Ω=0.01 mm and the difference in radius cited above would be $(b_2-b_{min})=b_2-(b_0-\Delta b(\chi_s))=0.05$ mm.

FIG. 5 shows the point of full mesh for a running set in which both the external toothing 1*a* and the internal toothing 2*i* have been generated in accordance with the invention. Both the tip profile of the external toothing 1*a* and the tip profile of the internal toothing 2*i* is flattened in the direction of the respective rolling circle $W_1$ and $W_2$ in accordance with the invention, as described with regard to FIG. 3. The tip profiles derived from cycloids are identify as $E1_{mod}$ and $H2_{mod}$. Since the flattening of the tip profiles due to varying the pitch circle, in the case of the external toothing 1*a* on the one hand and the internal toothing 2*i* on the other, may be identical but need not be identical, the radial spacing between the vertices of the tips and roots is differentially identified by $P_R$ and $P'_R$, wherein the curves H1 and $H2_{mod}$ must be turned in the mind to the point of full mesh. As in the running set in FIG. 4, the tangential clearance $P_T$ is obtained by offset production, i.e. by equidistantly offsetting, at least one, preferably only one, of the two toothings 1*a* and 2*i* by the amount Ω. In the case of the toothings 1*a* and 2*i* in FIG. 5, the spacing between the opposing tips at the point of minimum mesh is not, however, $P_R$ but rather $P_R+P'_R+\Omega$.

FIG. 6 shows the point of full mesh for a running set in accordance with a third example embodiment. The tip profiles $E1_{mod}$ and $H2_{mod}$ are formed in accordance with the invention. The two root profiles $H1_{mod}$ and $E2_{mod}$ are generated by the rolling action of a pitch circle of variable radius on the rolling circle $W_1$ and of a pitch circle of variable radius on the rolling circle $W_2$ of the external gear 2. In generating the root profiles, the radius of the corresponding pitch circle is however expanded, from the vertex of the root to the two flanks, to reduce the dead spaces between the roots and mating tips, except for one squeeze fluid space sufficient for receiving and/or discharging the squeeze fluid. It is assumed that the radial clearance overall corresponds to that of the example embodiment in FIG. 5.

Figure 7:
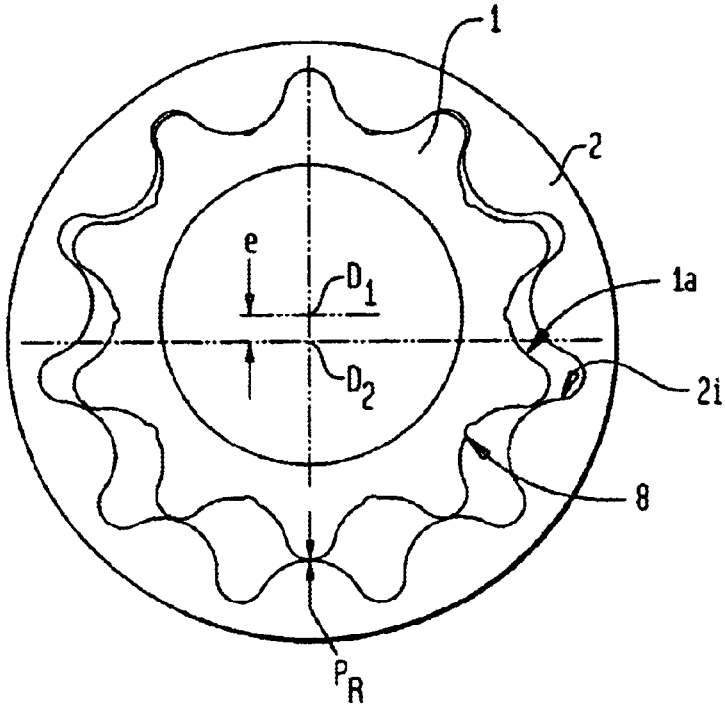
FIG. 7 a running set comprising squeeze fluid spaces.

FIG. 7 shows two meshing gears 1 and 2 with toothings 1*a* and 2*i*, of which at least one is generated in accordance with the invention. To create spaces for squeeze fluid at the point of full mesh, or to expand those already present, an axial groove 8 is machined into the base of each of the roots of the internal gear 1. If the gears 1 and 2 form the running set of a ring gear pump, then each of the axial grooves 8 communicates with the discharge of the ring gear pump. The toothings 1*a* and 2*i* correspond to the teaching of claim 14, according to which the teeth of the internal gear 1, gauged on the reference circle or rolling circle of the gear 1, are thinner than the tooth gaps. Selecting the ratio of the circumferential extent of the tooth gaps relative to the teeth, gauged on the rolling circle or reference circle, in the range 1.5 to 3 minimizes the inevitable instant pulsations in the pump delivery.

Figure 8:
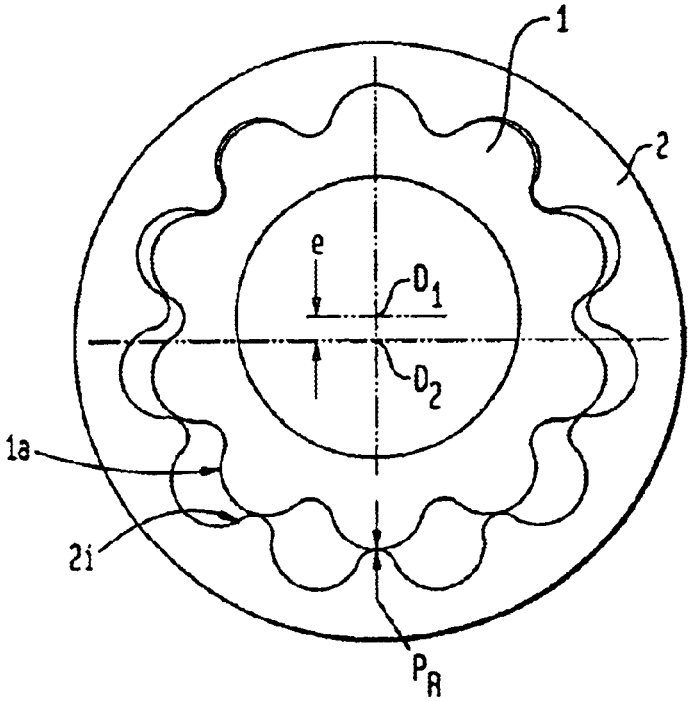
FIG. 8 a running set, the teeth and gaps of which are of different thicknesses, gauged over each rolling circle, respectively.

FIG. 8 illustrates a ring gear machine according to another exemplary embodiment of the present invention. According to this embodiment, pulsations in the delivery can also be minimized by selecting the inverse ratio of the circumferential extent. In the example embodiment in FIG. 8, the teeth of the external toothing 1*a* are correspondingly thicker than its tooth gaps.

Figure 9:
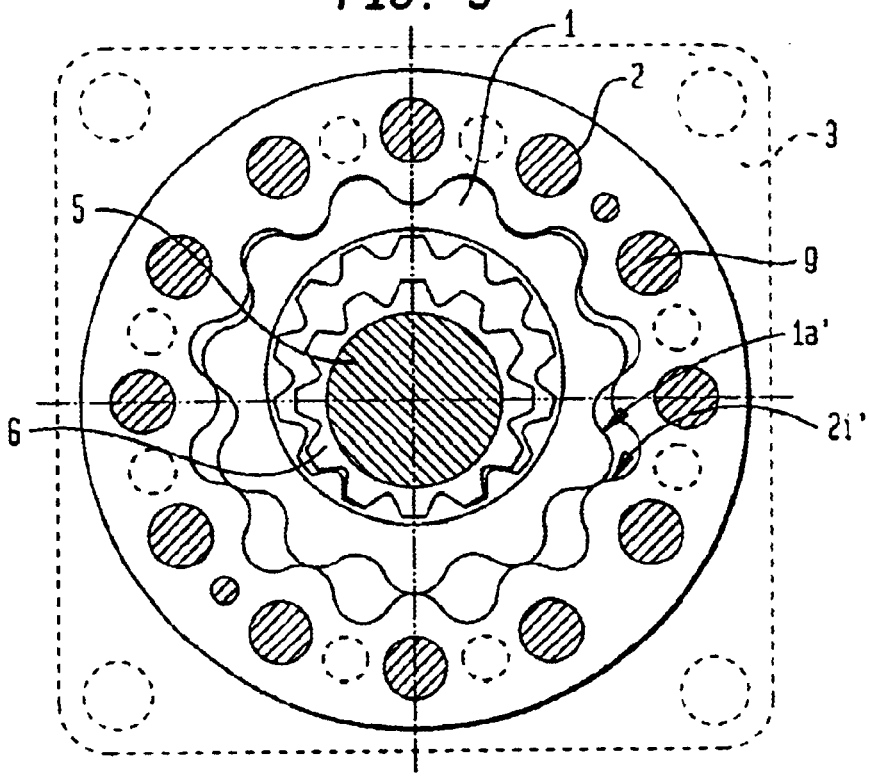
FIG. 9 an orbital machine comprising an external gear non-rotatably connected to a casing.

The ring gear machine in FIG. 9 is operated as a motor. The external gear 2 is non-rotatably connected to the casing 3 via a plurality of bolts 9 arranged uniformly distributed about the circumference of the external gear 2, thus forming a stator with an internal toothing 2*i*. The ring gear machine is configured as an orbital machine. The internal gear 1 comprises, in addition to its external toothing 1*a*, an internal toothing meshing with a drive pinion 6 non-rotatably secured to a rotary drive member 5. At least one of the toothings 1*a* and 2*i* is configured in accordance with the invention. It may in particular be configured as outlined by way of FIG. 3.

Figure 10:
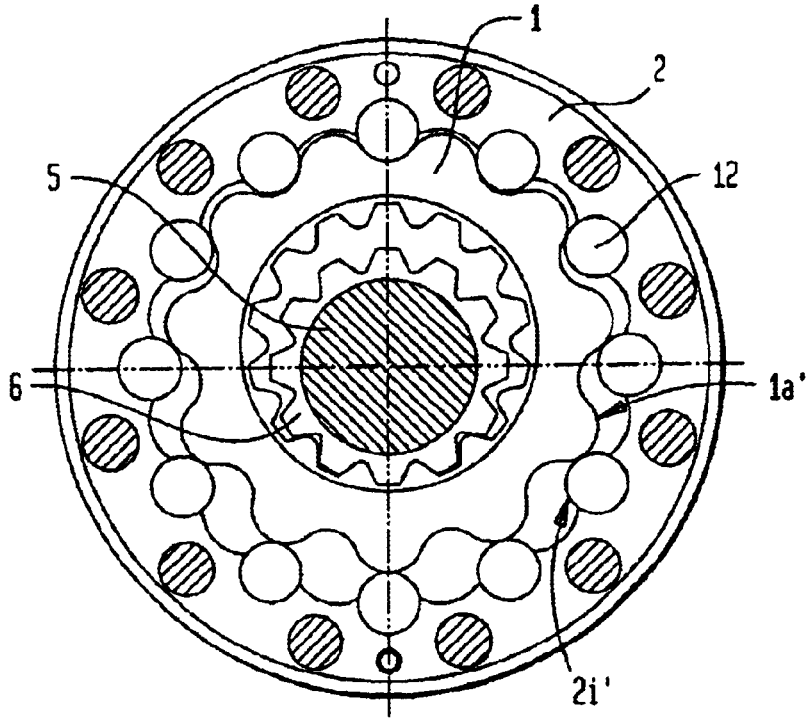
FIG. 10 a running set of an orbital machine, comprising an external gear, the teeth of which are formed by rollers.

FIG. 10 shows a further example of a running set which likewise comprises an external gear 2 which when fitted forms a stator of an orbital machine. In the example embodiment in FIG. 10, the external gear 2 comprises a gerotor internal toothing 2*i'*. The teeth, in particular the tips, of the internal toothing 2*i'* of the external gear 2 are formed by rollers, individually rotatably connected to the remainder of the external gear 2 about their longitudinal centerlines parallel to the rolling circle axis of the external gear 2. All the rollers 12 have the same, constant radius.

The counterpart toothing, namely the external toothing 1*a'* of the internal gear 1, is likewise generated by varying the radius, but not by the rolling action of a pitch circle on a fixed circle, but by varying the radius of the rollers 12 in the generator or envelope process by which the external toothing 1*a'* is generated. In the envelope process, the radius of the rollers 12 is not, however, treated as constant, but becomes continuously larger starting from a minimum value. The radius of the rollers 12 for obtaining the vertex of each of the tips of the external toothing 1*a'* exhibits the minimum value. From the vertices to the two flank areas, preferably down to the two root points of the tip flanks on the rolling circle of each of the tips of the external toothing 1*a'*, the radius of the rollers 12 is increased up to the value exhibited by the rollers 12 of the internal toothing 2*i'* actually implemented. The tangential clearance is thus increased relative to the tangential clearance from the envelope process using a constant radius.

What is claimed is:

1. A displacement-type ring gear machine (pump or motor) including:

a) a casing defining a gear chamber comprising at least one supply port and at least one discharge port for a working fluid;

b) an internal gear accommodated in the gear chamber, the internal gear being rotatable about an axis of rotation and comprising an external toothing; and c) a gear comprising a rolling circle axis eccentric to the axis of rotation of the internal gear and an internal toothing about the rolling circle axis having at least one tooth more than the external toothing and meshing with the external toothing so as to form expanding and contracting fluid cells which direct the working fluid from the at least one supply port to the at least one discharge port when one of the gears performs a rotational movement relative to the other, d) at least one of the toothings having tips or roots comprising a profile derived from a cycloid, which is generated by the rolling action of a pitch circle on a fixed circle, e) and the meshing toothings comprising a radial clearance and a tangential clearance, wherein f) the tangential clearance is smaller than the radial clearance, g) and the profile of the tips or roots of the at least one of the toothings is formed by the locus of a point on the circumference of a pitch circle whose radius becomes continuously smaller from the two flank portions to the vertex portion in the case of the tips and becomes continuously larger in the case of the roots.

2. The ring gear machine as set forth in claim 1, wherein the profile of the tips is formed by the locus of a point on the circumference of a first pitch circle whose radius becomes continuously smaller from the two flank portions to the vertex portion, and the profile of the roots is formed by the locus of a point on the circumference of a second pitch circle whose radius becomes continuously larger from the two flank portions to the vertex portion of the roots.

3. The ring gear machine as set forth in claim 1, wherein the profile of the tips of the other of the two toothings is formed by the locus of a point on the circumference of a third pitch circle whose radius becomes continuously smaller from the two flank portions to the vertex portion of the tips.

4. The ring gear machine as set forth in claim 1, wherein the profile of the roots of the other of the two toothings is formed by the locus of a point on the circumference of a fourth pitch circle whose radius becomes continuously larger from the two flank portions to the vertex portion of the roots.

5. The ring gear machine as set forth in claim 1, wherein the profile of the tips of the at least one of the toothings is formed by the locus of a point on the circumference of a pitch circle whose radius becomes continuously smaller from the two flank portions to the vertex portion of the tips and the profile of the roots of the other of the two toothings is formed by the locus of a point on the circumference of a fourth pitch circle whose radius becomes continuously smaller from the two flank portions to the vertex portion of the roots.

6. The ring gear machine as set forth in claim 1, wherein in the rolling action, the radius of the pitch circle changes in accordance with a linear function or a sine or cosine function or an at least second order function.

7. The ring gear machine as set forth in claim 1, wherein in the rolling action, the radius of the pitch circle changes in accordance with a function as gained from experience.

8. The ring gear machine as set forth in claim 1, wherein the tangential clearance amounts to 20 to 60% of the radial clearance.

9. The ring gear machine as set forth in claim 1, wherein the tip profiles and root profiles of the two toothings are derived from cycloids, and the generating pitch circles of the profiles matched to each other such that from the loci of the points on the circumferences of the pitch circles, at least a part of the tangential clearance gauged at the rolling circle is obtained.

10. The ring gear machine as set forth in claim 1, wherein the profiles of the tips and roots of the toothings point tangentially toward each other at the intersections.

11. The ring gear machine as set forth in claim 1, wherein only one of the two toothings comprises a profile for generating which the pitch circle of the tips and/or the pitch circle of the roots changes.

12. The ring gear machine as set forth in claim 1, wherein the profiles of the tips and/or roots of the two toothings are each formed by or from the loci of points on the circumference of pitch circles whose radii continuously change from the vertex portion to the two flank portions of the tips and/or roots.

13. The ring gear machine as set forth in claim 1, wherein the circumferential extent of the tooth gaps of the external toothing and teeth of the internal toothing, as gauged on the corresponding rolling circle, amounts to 1.5 to 3 times the circumferential extent of the teeth of the external toothing and tooth gaps of the internal toothing, as gauged on the corresponding rolling circle.

14. The ring gear machine as set forth in claim 1, wherein the circumferential extent of the teeth of the external toothing and tooth gaps of the internal toothing, as gauged on the corresponding rolling circle amounts to 1.5 to 3 times the circumferential extent of the tooth gaps of the external toothing and teeth of the internal toothing, as gauged on the corresponding rolling circle.

15. The ring gear machine as set forth in claim 1, wherein in the roots of at least one of the toothings, hollows are provided for squeeze fluid.

16. The ring gear machine as set forth in claim 1, wherein one of the gears forms a stator which is non-rotational relative to the casing, for motor operation.

17. The ring gear machine as set forth in claim 16, wherein the one of the gears which forms the stator is the external gear.

18. The ring gear machine as set forth in claim 1, wherein in the rolling action, the radius of the pitch circle changes in accordance with a conic section function or a polynome.

19. The ring gear machine as set forth in claim 1, wherein the profile of the tips of the other of the two toothings is formed from the locus of a point on the circumference of a third pitch circle whose radius becomes continuously smaller from the two flank portions to the vertex portion of the tips.

20. The ring gear machine as set forth in claim 1, wherein the profile of the roots of the other of the two toothings is formed from the locus of a point on the circumference of a fourth pitch circle whose radius becomes continuously larger from the two flank portions to the vertex portion of the roots.

21. The ring gear machine as set forth in claim 1, wherein the profile of the tips of the at least one of the toothings is formed by the locus of a point on the circumference of a pitch circle whose radius becomes continuously smaller from the two flank portions to the vertex portion of the tips and the profile of the roots of the other of the two toothings is formed from the locus of a point on the circumference of a fourth pitch circle whose radius becomes continuously smaller from the two flank portions to the vertex portion of the roots.

22. A running set for a displacement-type ring gear machine, the running set including:

a) an internal gear with an external toothing, b) an external gear with an internal toothing comprising at least one tooth more than the external toothing and forming expanding and contracting fluid cells with the external toothing in a meshing action of the toothings in which an axis of rotation of one of the gears is eccentric to a rolling circle axis of the other of the gears, c) at least one of the toothings having tips or roots comprising a profile derived from a cycloid, which is generated by the rolling action of a pitch circle on a fixed circle, d) and the meshing toothings comprising a radial clearance and a tangential clearance, wherein e) the tangential clearance is smaller than the radial clearance;

f) and the profile of the tips or roots of the at least one of the toothings is formed by the locus of a point on the circumference of a pitch circle whose radius becomes continuously smaller from the two flank portions to the vertex portion in the case of the tips and becomes continuously larger in the case of the roots.

23. A displacement-type ring gear machine (pump or motor) including:

a) a casing defining a gear chamber comprising at least one supply port and at least one discharge port for a working fluid;

b) an internal gear accommodated in the gear chamber, the internal gear being rotatable about an axis of rotation and comprising an external toothing;

c) a gear comprising a rolling circle axis eccentric to the axis of rotation of the internal gear and an internal toothing about the rolling circle axis having at least one tooth more than the external toothing and meshing with the external toothing so as to form expanding and contracting fluid cells which direct the working fluid from the at least one supply port to the at least one discharge port, when one of the gears performs a rotational movement relative to the other, d) at least one of the toothings having tips or roots comprising a profile derived from a cycloid that is generated by the rolling action of a pitch circle on a fixed circle, e) and the meshing toothings comprising a radial clearance and a tangential clearance, wherein f) the tangential clearance is smaller than the radial clearance, g) and the profile of the tips or roots of the at least one of the toothings is formed by the locus of a point on the circumference of a pitch circle whose radius becomes continuously smaller from the two flank portions to the vertex portion in the case of the tips and becomes continuously larger in the case of the roots, wherein h) the profile of the at least one of the two toothings is equidistantly offset as compared to the specification for generating the profile forming the locus, so as to obtain at least a part of the tangential clearance as gauged at the rolling circle.

24. The ring gear machine as set forth in claim 23, wherein the profile of the tips is formed from the locus of a point on the circumference of a first pitch circle whose radius becomes continuously smaller from the two flank portions to the vertex portion, and the profile of the roots is formed from the locus of a point on the circumference of a second pitch circle whose radius becomes continuously larger from the two flank portions to the vertex portion of the roots.

25. A displacement-type ring gear machine (pump or motor) including:

a) a casing defining a gear chamber comprising at least one supply port and at least one discharge port for a working fluid;

b) an internal gear accommodated in the gear chamber, the internal gear being rotatable about an axis of rotation and comprising an external toothing;

c) a gear comprising a rolling circle axis eccentric to the axis of rotation of the internal gear and an internal toothing about the rolling circle axis having at least one tooth more than the external toothing and meshing with the external toothing so as to form expanding and contracting fluid cells which direct the working fluid from the at least one supply port to the at least one discharge port, when one of the gears performs a rotational movement relative to the other, d) at least one of the toothings having tips or roots comprising a profile derived from a cycloid, that is generated by the rolling action of a pitch circle on a fixed circle, e) and the meshing toothings comprising a radial clearance and a tangential clearance, wherein f) the tangential clearance is smaller than the radial clearance, g) and the profile of the roots of the at least one of the toothings is formed by the locus of a point on the circumference of a pitch circle whose radius becomes continuously smaller from the two flank portions to the vertex portion.

26. A running set for a displacement-type ring gear machine, the running set including:

a) an internal gear with an external toothing, b) an external gear with an internal toothing comprising at least one tooth more than the external toothing and forming expanding and contracting fluid cells with the external toothing in a meshing action of the toothings in which an axis of rotation of one of the gears is eccentric to a rolling circle axis of the other of the gears, c) at least one of the toothings having tips or roots comprising a profile derived from a cycloid that is be generated by the rolling action of a pitch circle on a fixed circle, d) and the meshing toothings comprising a radial clearance and a tangential clearance, wherein e) the tangential clearance is smaller than the radial clearance;

f) and the profile of the tips or roots of the at least one of the toothings is formed by the locus of a point on the circumference of a pitch circle whose radius becomes continuously smaller from the two flank portions to the vertex portion in the case of the tips and becomes continuously larger in the case of the roots, wherein h) the profile of the at least one of the two toothings is equidistantly offset as compared to the specification for generating the profile forming the locus, so as to obtain at least a part of the tangential clearance as gauged at the rolling circle.

* * * * *